US010835023B2

(12) United States Patent
Leebow

(10) Patent No.: US 10,835,023 B2
(45) Date of Patent: Nov. 17, 2020

(54) DETACHABLE HAIR COLORING BRUSH AND SYSTEM

(71) Applicant: Betty Dain Creations, LLC, Miami, FL (US)

(72) Inventor: Donald Leebow, Ft. Lauderdale, FL (US)

(73) Assignee: Betty Dain Creations, LLC, Miami, FL (US)

( * ) Notice: Subject to any disclaimer, the term of this patent is extended or adjusted under 35 U.S.C. 154(b) by 80 days.

(21) Appl. No.: 16/196,805

(22) Filed: Nov. 20, 2018

(65) Prior Publication Data

US 2020/0154870 A1 May 21, 2020

(51) Int. Cl.
*A45D 19/02* (2006.01)
*A46B 7/04* (2006.01)
(Continued)

(52) U.S. Cl.
CPC ..... *A46B 5/0095* (2013.01); *A45D 19/0008* (2013.01); *A45D 19/02* (2013.01);
(Continued)

(58) Field of Classification Search
CPC ..... A46B 5/0095; A46B 7/04; A46B 7/042; A46B 7/044; A46B 7/046; A46B 7/048; A46B 2200/104; A46B 2200/1046; A46B 2200/20; A46B 2200/202; A46B 2200/205; A46B 2200/207; A45D 34/042;
(Continued)

(56) References Cited

U.S. PATENT DOCUMENTS 4,754,516 A * 7/1988 Tremblay ..... A46B 5/0095 15/145
4,811,445 A * 3/1989 Lagieski ..... A46B 5/0095 15/104.94
(Continued)

FOREIGN PATENT DOCUMENTS

DE 102012010709 * 12/2013
DE 202019100868 * 4/2019
(Continued)

OTHER PUBLICATIONS

Betty Dain Creations, LLC, Buying Guide vol. 4—Salon Apparel, Hair Color Accessories, Salon Basics (12 pages), Published 2015.

*Primary Examiner* — Mark Spisich
(74) *Attorney, Agent, or Firm* — Akerman LLP; Peter A. Chiabotti

(57) ABSTRACT

The application provides a hair coloring brush. The hair coloring brush can include a handle and a detachable brush cap that detachably couples to the handle. The handle can include an elongated body, a brush attachment protrusion, where the brush attachment protrusion extends outward from the elongated body and has a first protrusion side and a second protrusion side. The handle can also include a first side ridge and a second side ridge. The detachable brush cap can include a distal brush end, a plurality of bristles, and a cavity opposite the distal brush end, where the cavity has a cavity wall and an internal groove located in the cavity wall. The first side ridge and the second side ridge can tension fit in the internal groove when the detachable brush cap is inserted over the brush attachment protrusion.

14 Claims, 14 Drawing Sheets

(51) Int. Cl.
*A45D 34/04* (2006.01)
*A46B 5/00* (2006.01)
*A45D 19/00* (2006.01)

(52) U.S. Cl.
CPC ..... *A45D 34/042* (2013.01); *A46B 7/042* (2013.01); *A45D 2019/0066* (2013.01); *A45D 2200/10* (2013.01); *A46B 2200/104* (2013.01); *A46B 2200/1046* (2013.01)

(58) Field of Classification Search
CPC .. A45D 40/262; A45D 40/28; A45D 2200/10; A45D 2200/109
USPC ..... 15/145, 146, 176.1, 176.6, 194, 202; 132/120, 150, 152, 270
See application file for complete search history.

(56) References Cited

U.S. PATENT DOCUMENTS 6,240,928 B1 6/2001 DaSilva
6,510,578 B1 * 1/2003 Cyr ..... A46B 7/04 15/176.1
6,848,452 B2 2/2005 Kennedy et al.
7,156,104 B2 1/2007 Kennedy et al.
D569,108 S 5/2008 Park
7,503,939 B2 3/2009 Umeno
D592,859 S 5/2009 Goddard-Clark et al.
8,118,037 B2 2/2012 Cardenas et al.
8,127,393 B1 6/2012 Dockter
D679,910 S 4/2013 Nimsgern
D684,373 S 6/2013 Rennette
D708,857 S 7/2014 Brown
D709,291 S 7/2014 Brown
D709,705 S 7/2014 Brown
8,919,353 B2 12/2014 Richardson
D730,060 S 5/2015 Rennette
D831,971 S 10/2018 Porcaro
2004/0159329 A1 8/2004 Kennedy et al.
2004/0211437 A1 10/2004 Kennedy et al.
2005/0257803 A1 11/2005 Albaneze
2007/0089760 A1 4/2007 Evanyk
2007/0119472 A1 5/2007 West
2007/0130701 A1 6/2007 Umeno
2010/0199449 A1 * 8/2010 Ho ..... A46B 3/005 15/207.2
2010/0300470 A1 12/2010 Richardson
2011/0083690 A1 4/2011 Cardenas et al.
2011/0088188 A1 4/2011 Ghodsi
2011/0299909 A1 12/2011 Madappattu
2012/0192893 A1 * 8/2012 Anderson ..... A45D 19/0008 132/219
2015/0136175 A1 5/2015 Bateh
2018/0035777 A1 2/2018 Richardson

FOREIGN PATENT DOCUMENTS

EP 640303 * 8/1994
GB 2035073 * 6/1980
GB 2381189 * 4/2003

* cited by examiner

DETACHABLE HAIR COLORING BRUSH AND SYSTEM

TECHNICAL FIELD

This application relates generally to hair coloring brushes and more particularly to detachable hair coloring brushes.

BACKGROUND

Hair coloring brushes are used for modern hair fashion looks. Some hair color services require multiple colors, different developers of the same color and other formulas for a variety of reasons. Highlights and lowlights can complicate hair colors. Hairstylists use a variety of brushes for coloring and highlighting a client's hair. Improved brushes in the industry are desired.

SUMMARY

A hair coloring brush with a handle and a detachable brush cap offers a number of advantages over prior hair coloring brushes. The disclosed hair coloring brush embodiments can be used with a number interchangeable detachable brush caps to offer a variety of cap sizes and bristle types. Alternative, the disclosed hair coloring brush embodiments can offer the same detachable brush cap to be used with a variety of handles of different sizes, shapes and structures that offer different functionalities. Still further, the disclosed hair coloring brush embodiments offer the ability of user to change detachable brush caps for use of the same handle with different detachable brush caps for different color agents or compositions so as to not use a previously used brush with a different color agents or compositions that would cause an undesired result if mixed together. In this regard, the disclosed hair coloring brush reduces waste associated with hair coloring brushes.

The hair coloring brush can include a handle and an a detachable brush cap that detachably couples to the handle. The handle can include an elongated body, a brush attachment protrusion, where the brush attachment protrusion extends outward from the elongated body and has a first protrusion side and a second protrusion side. The handle can also include a first side ridge on the first protrusion side and a second side ridge on the second protrusion side. The detachable brush cap can include a distal brush end, a plurality of bristles extending from the distal brush end, a cavity opposite the distal brush end, wherein the cavity has a cavity wall and an internal groove located in the cavity wall. The first side ridge on the first protrusion side and the second side ridge on the second protrusion side can tension fit in the internal groove when the detachable brush cap is inserted over the brush attachment protrusion.

In another embodiment, the first side ridge and the second side ridge can be not parallel to each other. Also, the first side ridge and the second side ridge can be substantially flat or have rounded distal ends.

In another embodiment, the brush attachment protrusion is substantially orthogonal to the elongated body. Further, the brush attachment protrusion has a brush attachment protrusion height and the cavity has a cavity depth, and the brush attachment protrusion height is substantially the same as the cavity depth.

In another embodiment, a concave surface can be located on the elongated body of the handle. In another embodiment, first protrusion side and the second protrusion side can be not parallel to each other. The hair coloring brush can also include a handle concave surface on the elongated body. And, the a cap concave surface can be located on the detachable brush cap.

In another embodiment, the hair coloring brush can also include handle concave surface on the elongated body and a cap concave surface on the detachable brush cap. In this arrangement, the handle concave surface and cap concave surface can form a continuous concave surface when the detachable brush cap is coupled to the handle.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
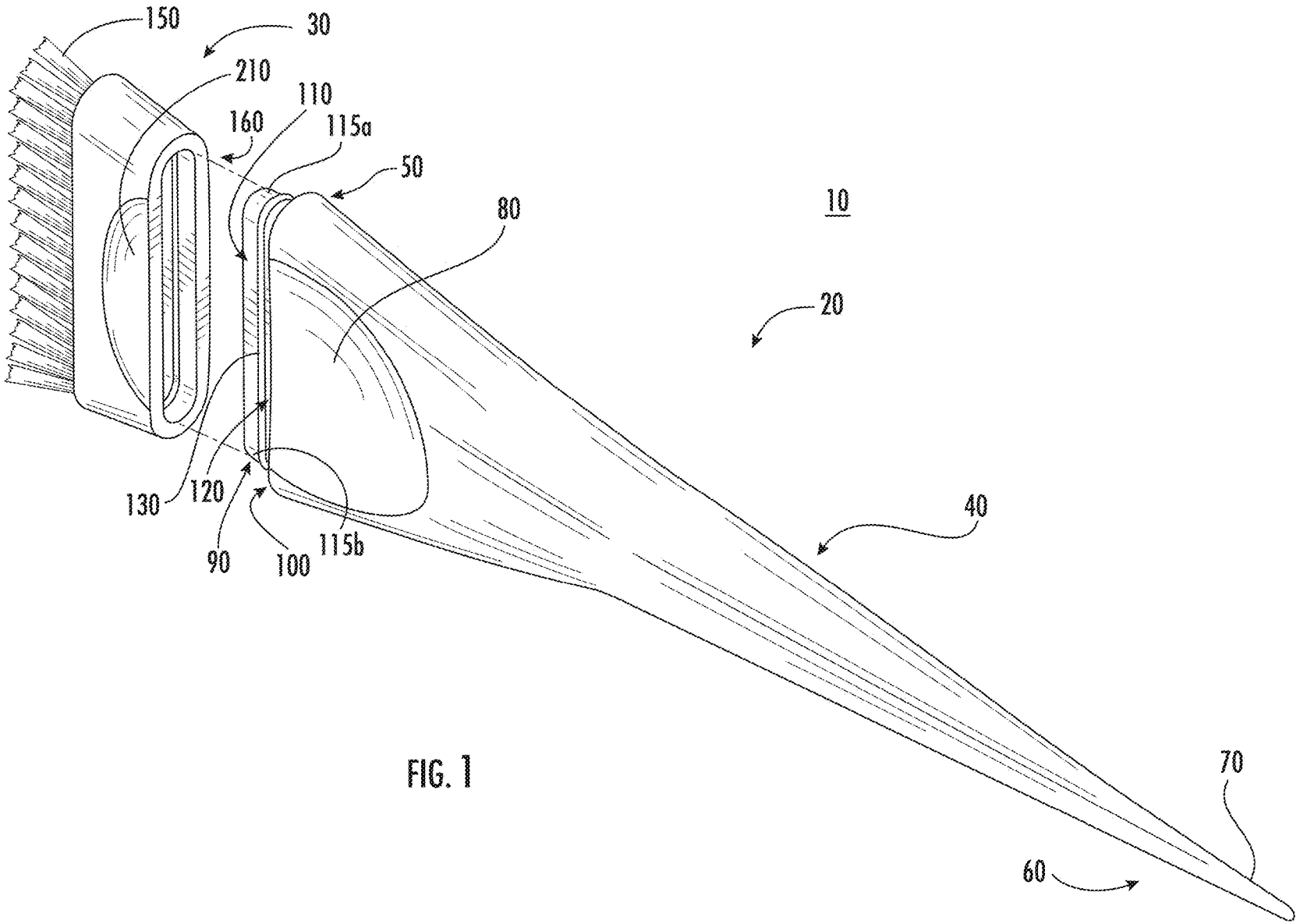
FIG. 1 is a perspective exploded view of a hair coloring brush.

Embodiments of the present disclosure are best understood by referring to FIGS. 1-21 of the drawings, like numerals being used for like and corresponding parts of the various drawings.

In one embodiment disclosed in FIGS. 1-9, a hair coloring brush 10 can have a handle 20 and a detachable brush cap 30. The detachable brush cap 30 can be removably attached to the handle 20 such that the detachable brush cap 30 can be attached to and removed from the handle 20.

The handle 20 can have an elongated body 40 that extends from a distal end 50, where the attachable brush cap 30 attaches to the handle 20, to the opposing end of the handle 20. The handle 20 can have an ergonomic shape that a user is able to firmly grasp. The handle 20 can terminate at a proximal end 60 in a pointed end 70. The pointed end 70 can be used by the stylist to separate strands of hair.

The handle 20 can also have a concave surface 80 located proximate to the distal end 50 of the handle 20. The concave surface 80 provides a grip surface for a user's finger, such as a user's thumb, when the handle 20 is held in the user's hand.

The distal end 50 of the handle 20 can include a brush attachment protrusion 90 having a brush attachment protrusion height. In one example, the brush attachment protrusion height can be 14 cm. The brush attachment protrusion 90 can extend outward from a flat surface 100 on the distal end 50 of handle 20 the length of the brush attachment protrusion height. The brush attachment protrusion 90 can be substantially orthogonal to the flat surface 100. In another embodiment, the brush attachment protrusion 90 can be not orthogonal to the flat surface 100.

The brush attachment protrusion 90 can have a first side 110 and a second side 120, which can be substantially flat surfaces. The first side 110 and the second side 120 can be substantially parallel to each other. In another embodiment, the first side 110 and the second side 120 can be not parallel to each other. As an example, one of the first side 110 and the second side 120, or both first side 110 and the second side 120, can be angled toward or away from each other. In one example, one of first side 110 and the second side 120, or both the first side 110 and the second side 120, can form an angle with the flat surface 100 that is greater than or equal to approximately 90°. In another embodiment, one of the first side 110 and the second side 120, or both first side 110 and the second side 120, can form an angle with the flat surface 100 that is approximately 90°.

Figure 2:
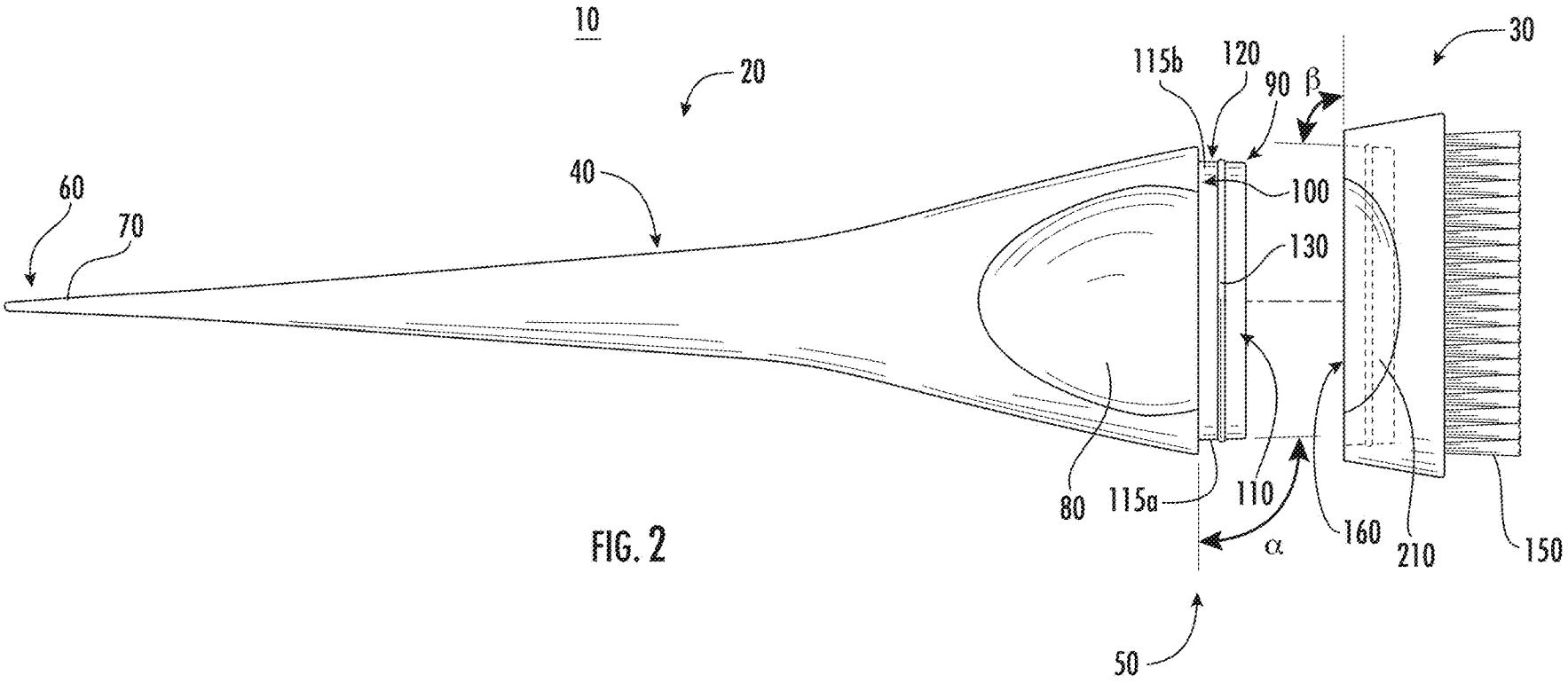
FIG. 2 is a top view of the hair coloring brush of FIG. 1.
Figure 3:
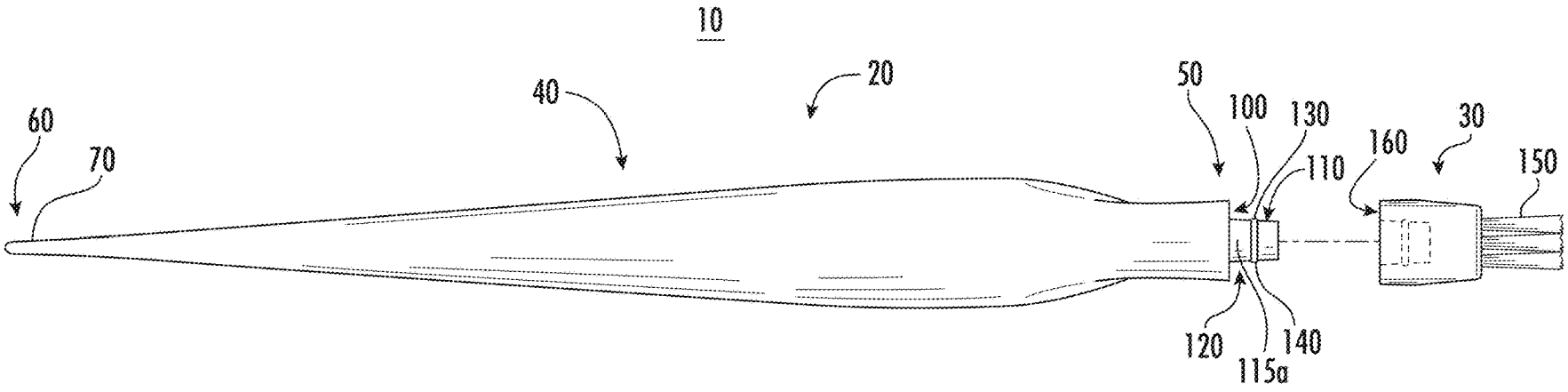
FIG. 3 is a side view of the hair coloring brush of FIG. 1.
Figure 4:
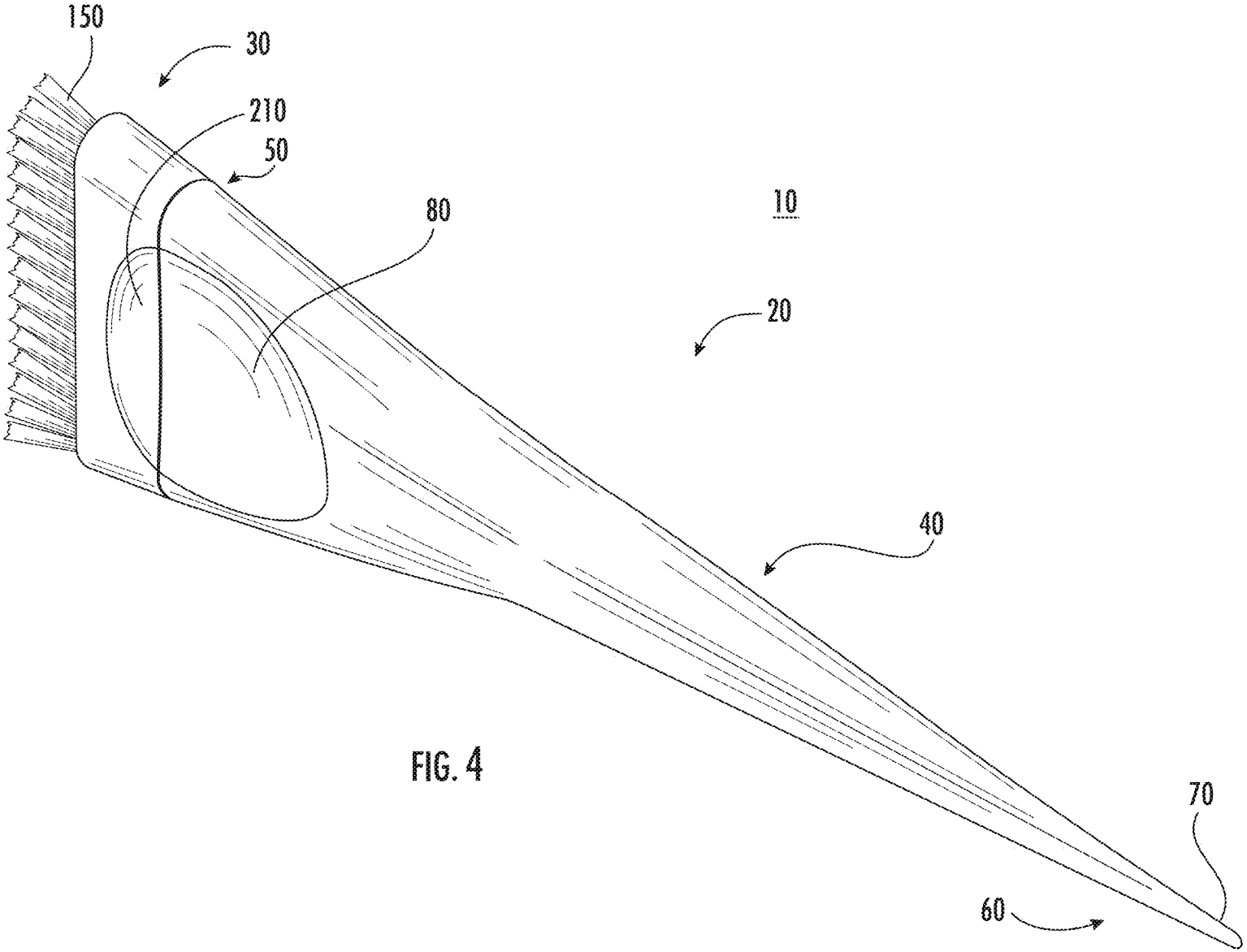
FIG. 4 is perspective view of an assembled hair coloring brush.
Figure 5:
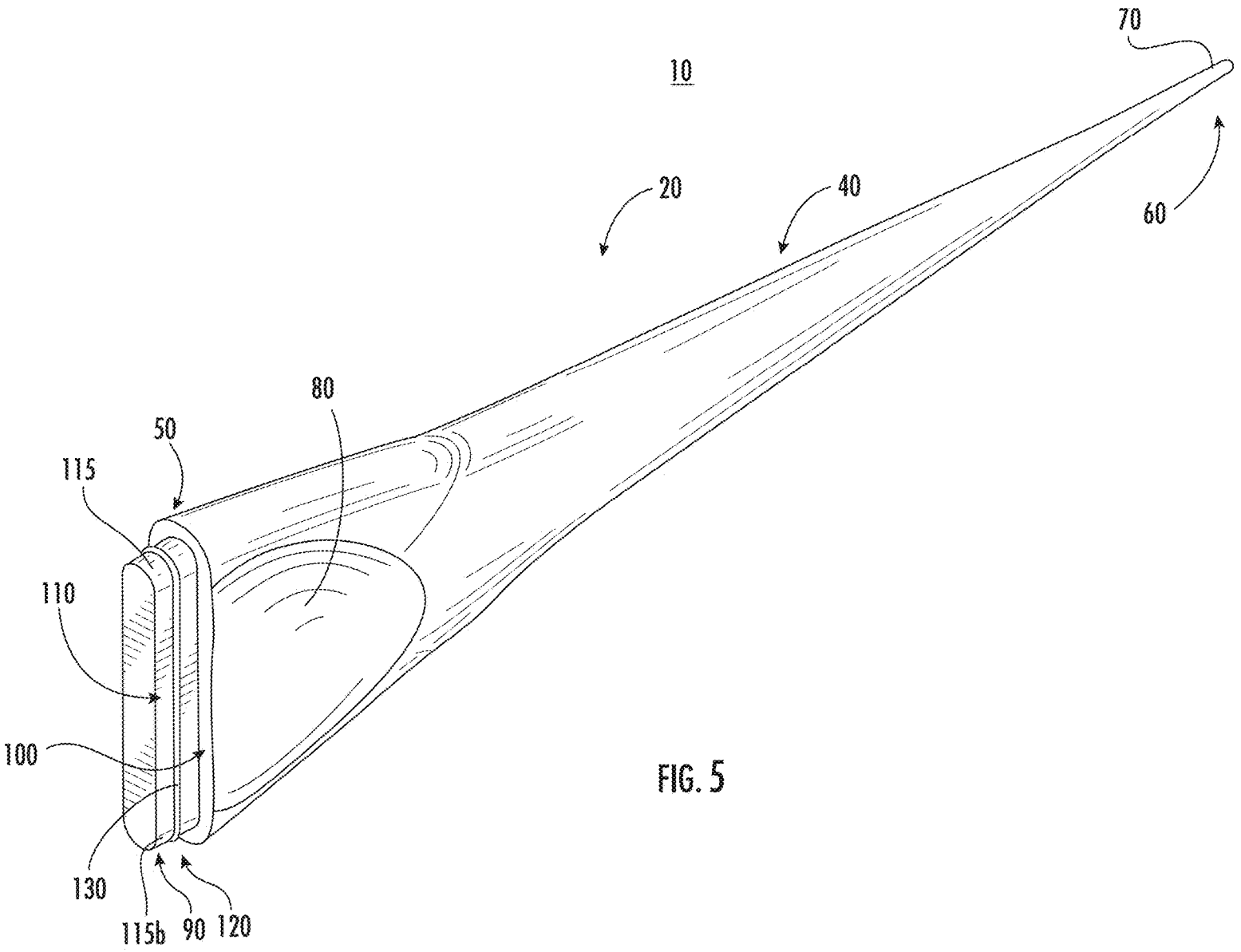
FIG. 5 is a perspective view of a component of the hair coloring brush.
Figure 6:
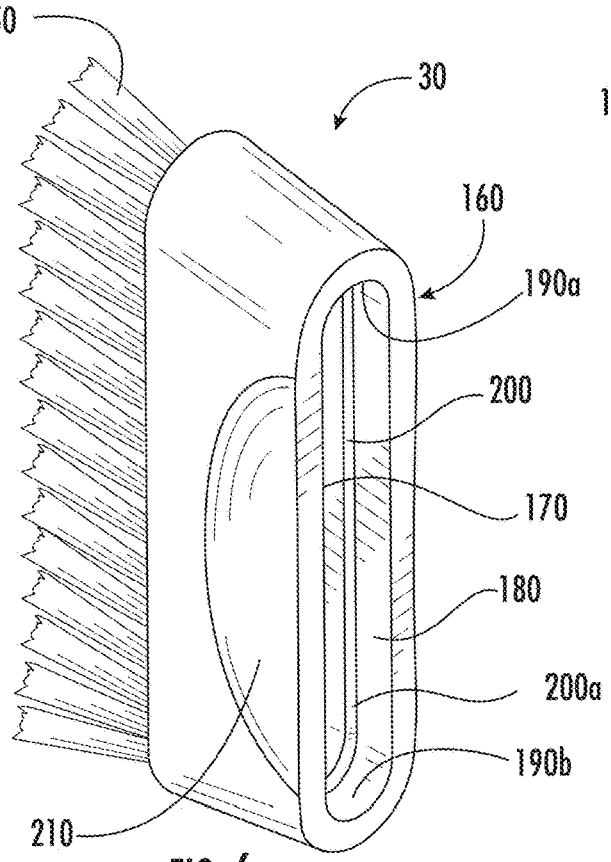
FIG. 6 is a perspective view of a component of the hair coloring brush.
Figure 7:
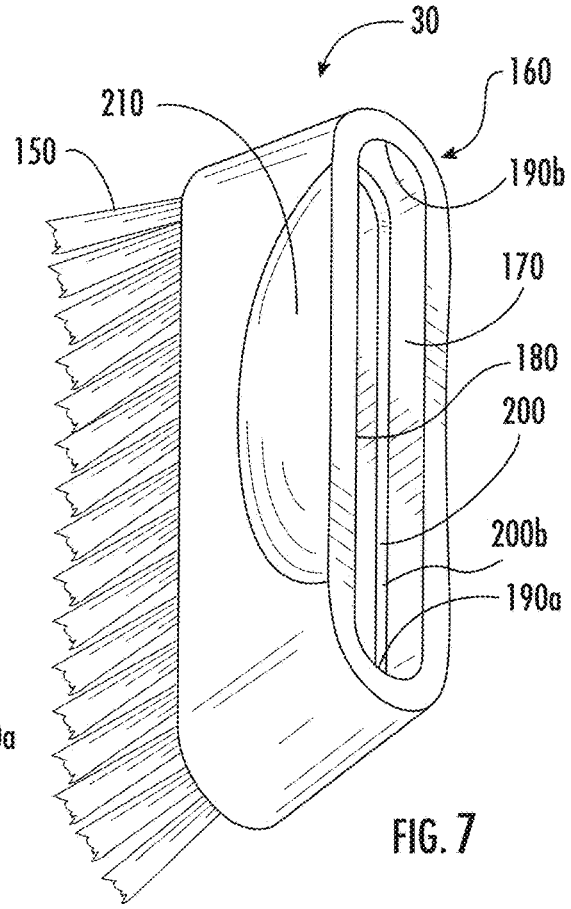
FIG. 7 is another perspective view of a component of the hair coloring brush.
Figure 8:
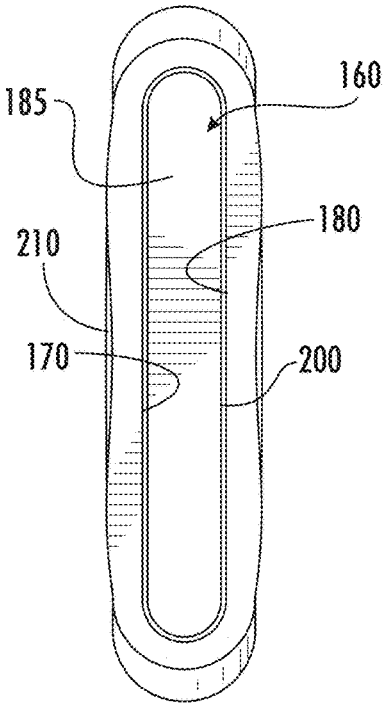
FIG. 8 is a bottom view of a component of the hair coloring brush.
Figure 9:
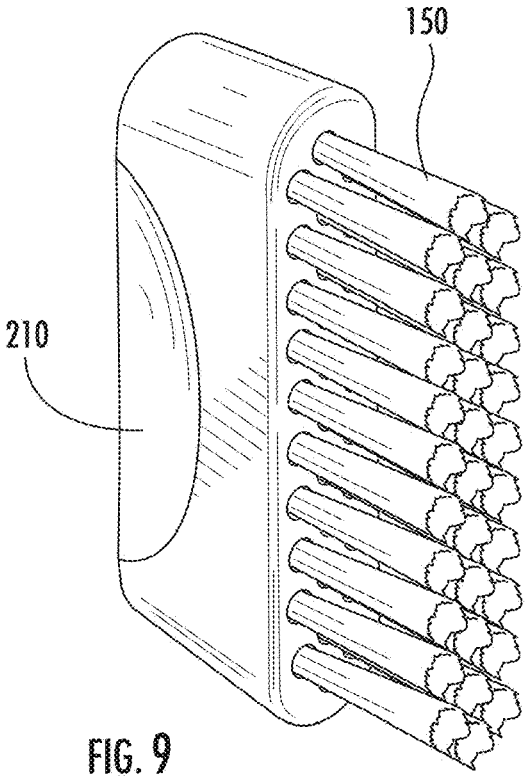
FIG. 9 is another perspective view of a component of the hair coloring brush.
Figure 10:
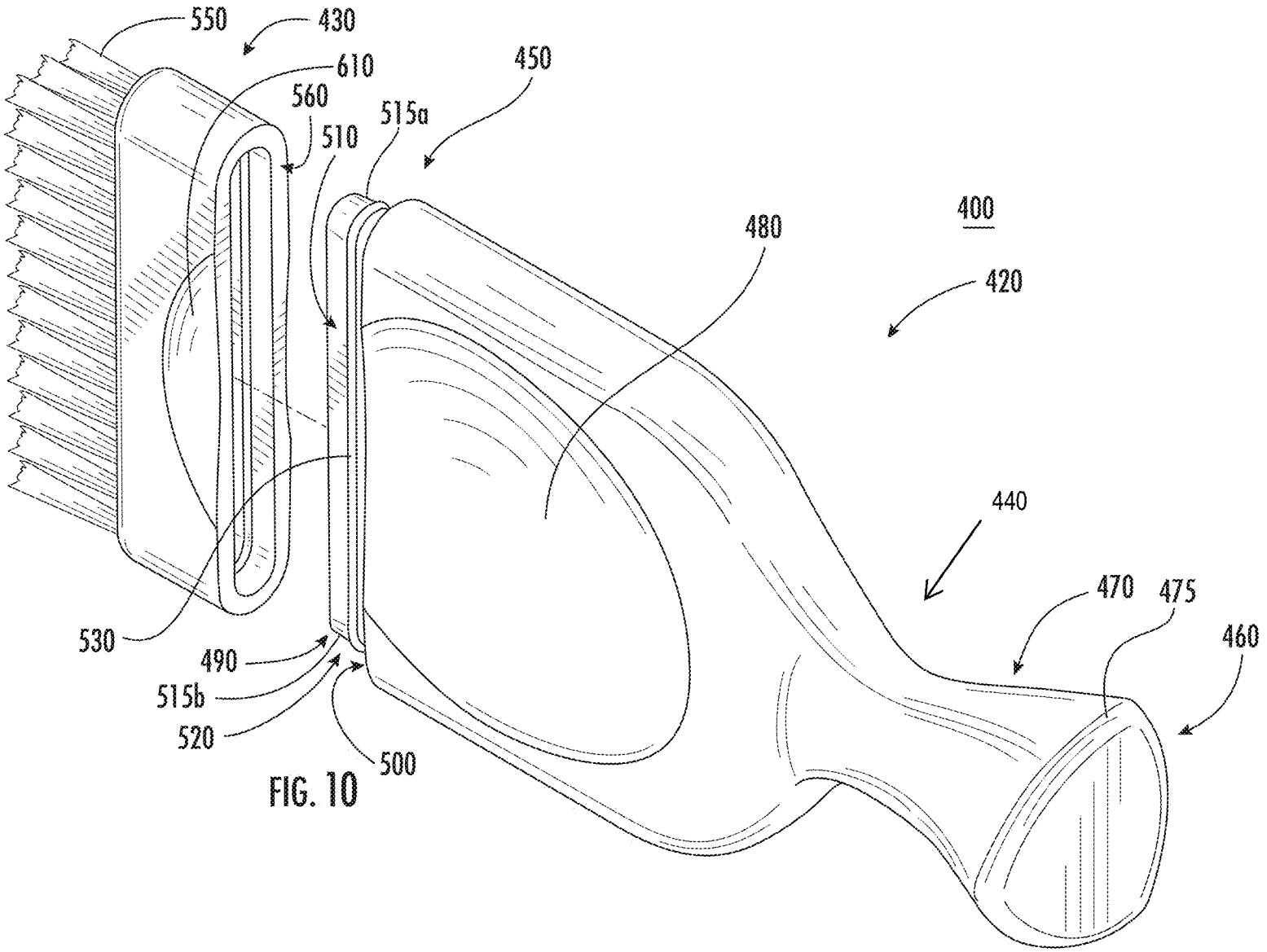
FIG. 10 is a perspective exploded view of another embodiment of a hair coloring brush.
Figure 11:
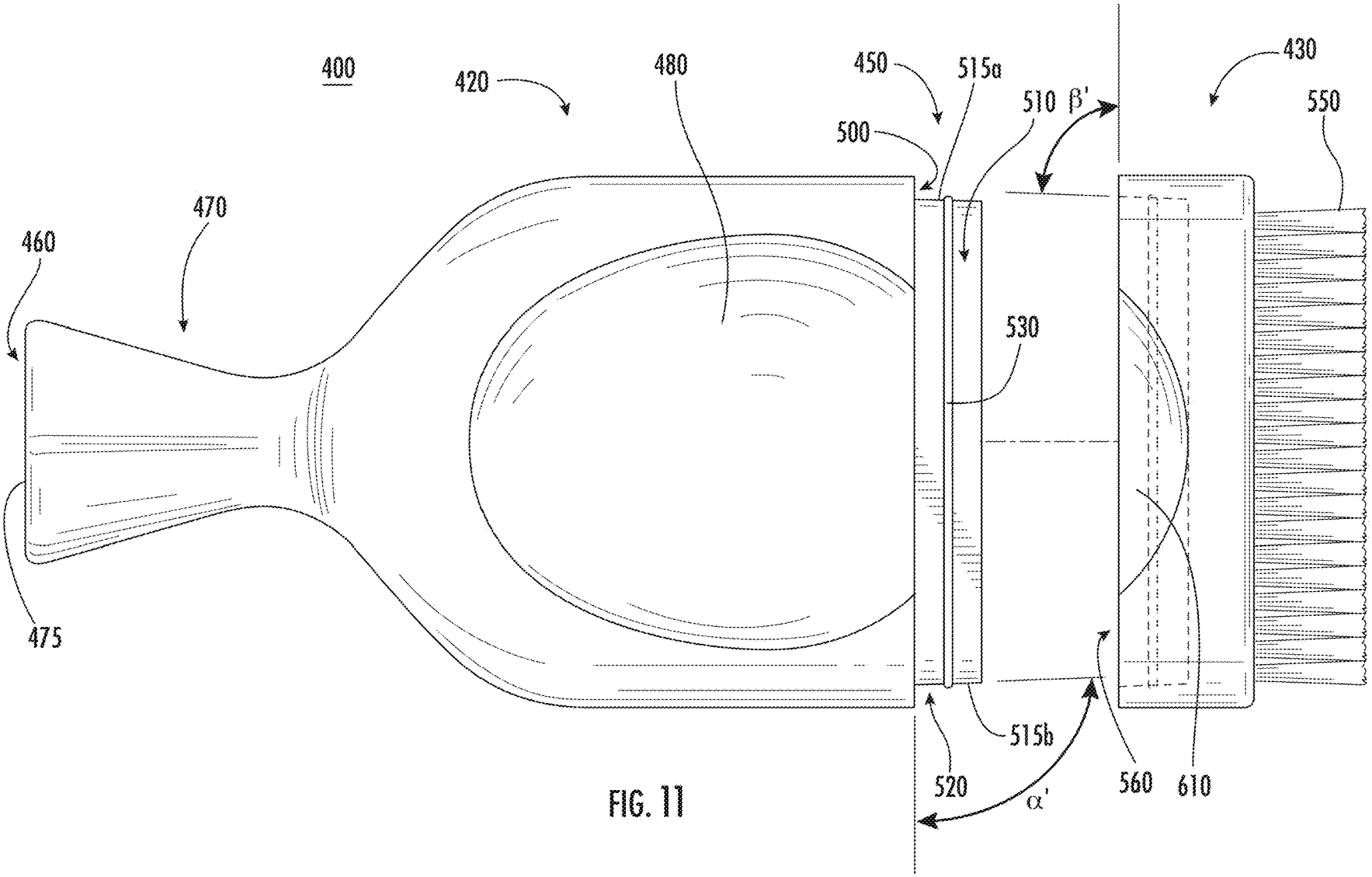
FIG. 11 is a top view of the hair coloring brush of FIG. 10.
Figure 12:
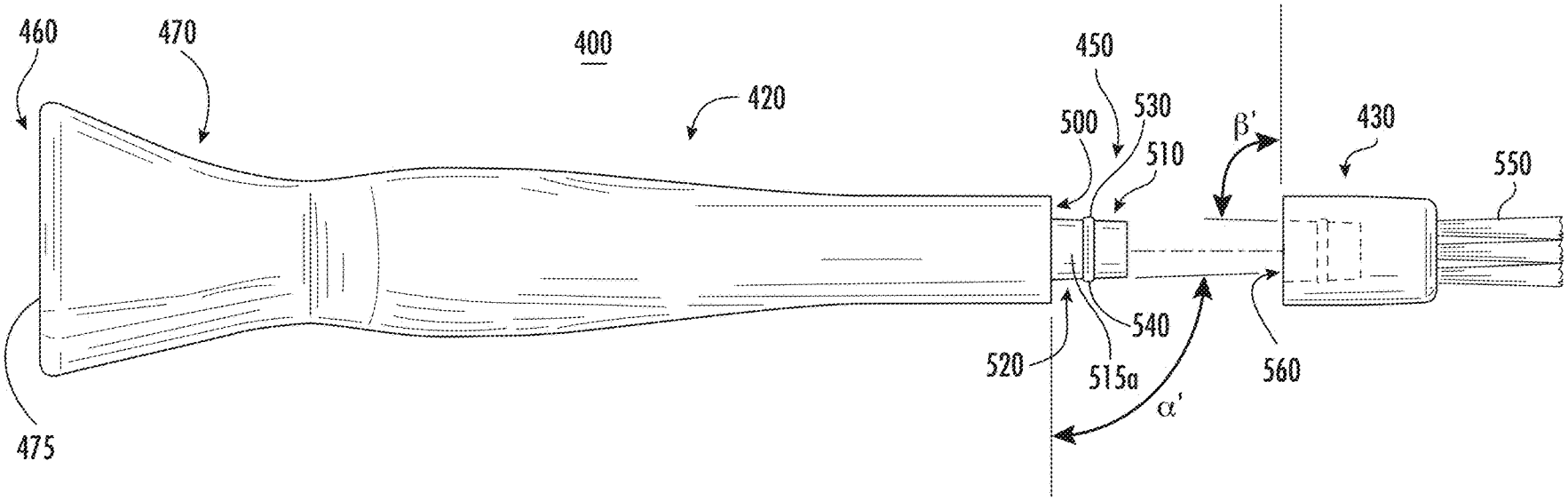
FIG. 12 is a side view of the hair coloring brush of FIG. 10.
Figure 13:
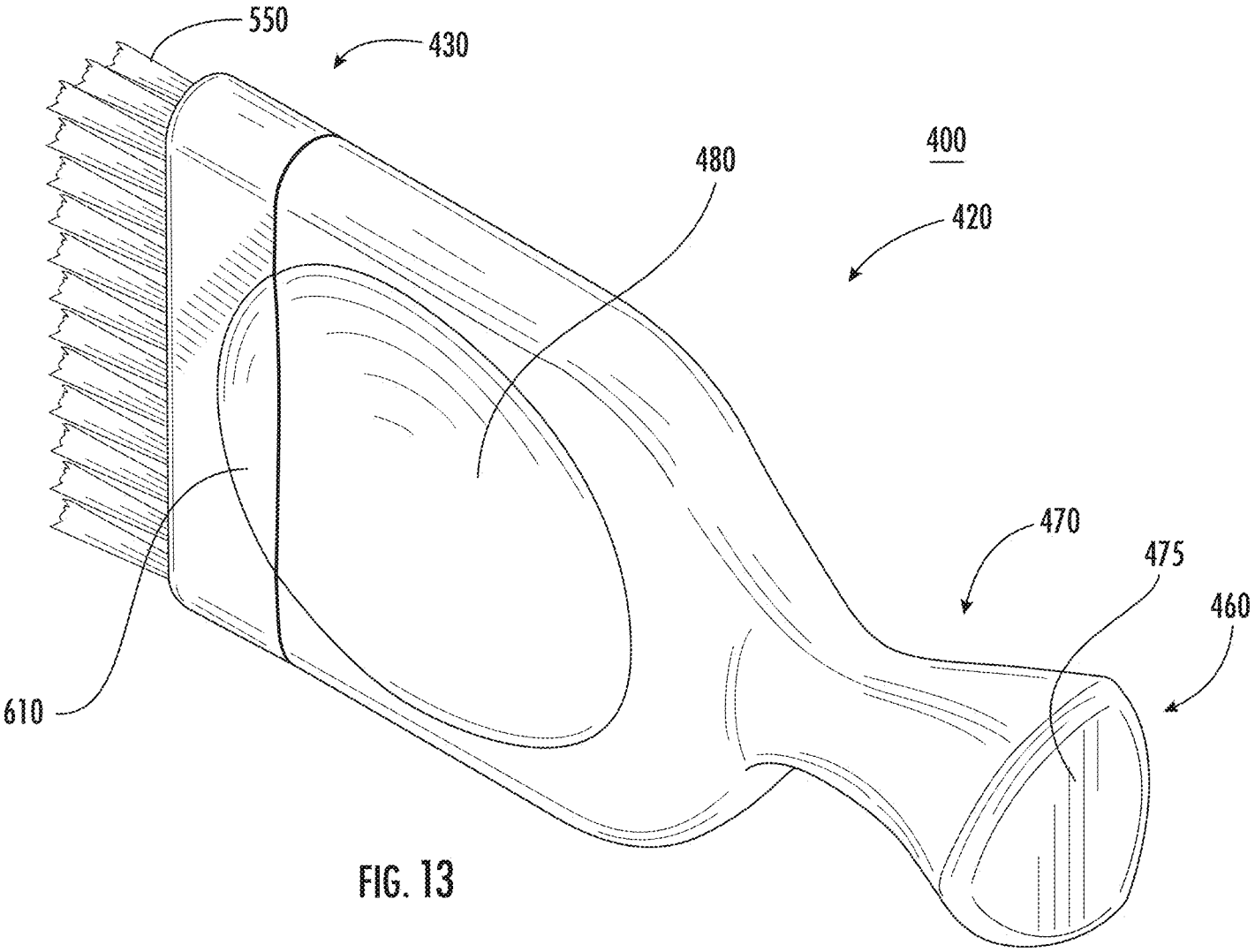
FIG. 13 is a perspective view of an assembled hair coloring brush.
Figure 14:
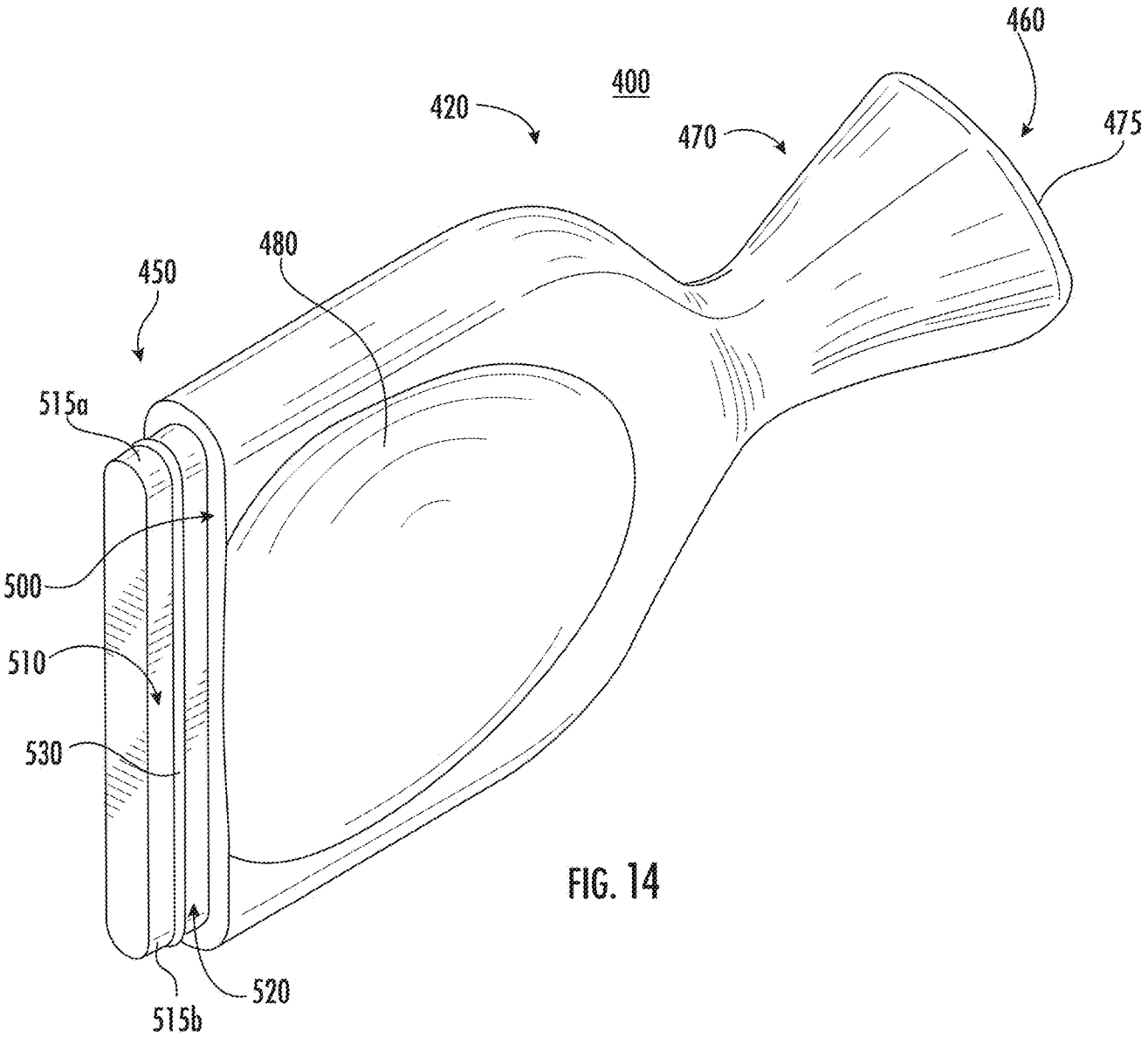
FIG. 14 is a perspective view of a component of the hair coloring brush.
Figure 15:
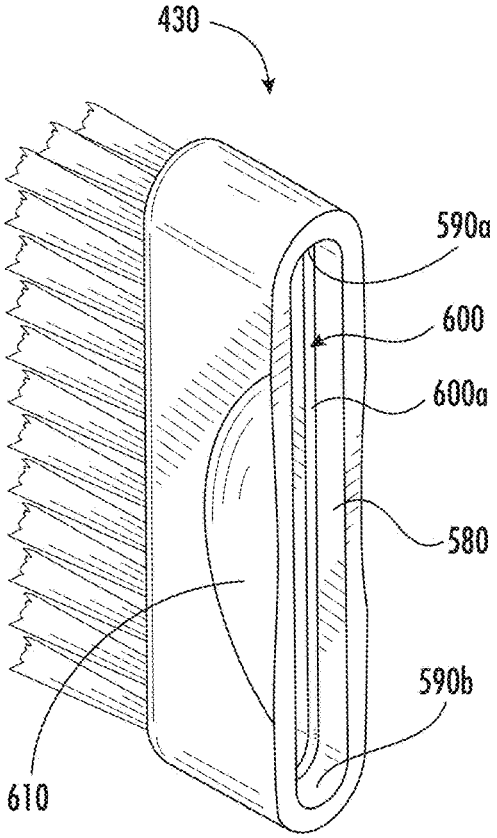
FIG. 15 is a perspective view of a component of the hair coloring brush.
Figure 16:
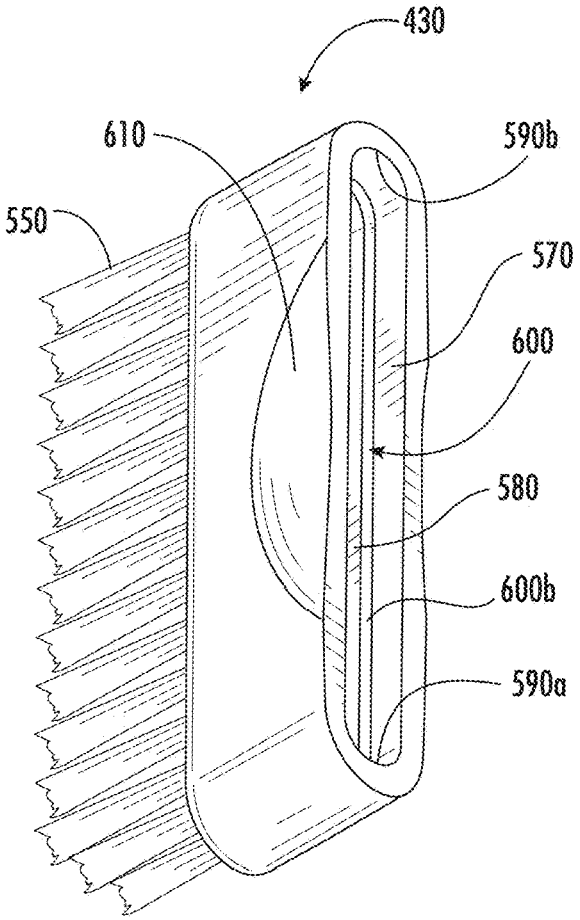
FIG. 16 is another perspective view of a component of the hair coloring brush.
Figure 17:
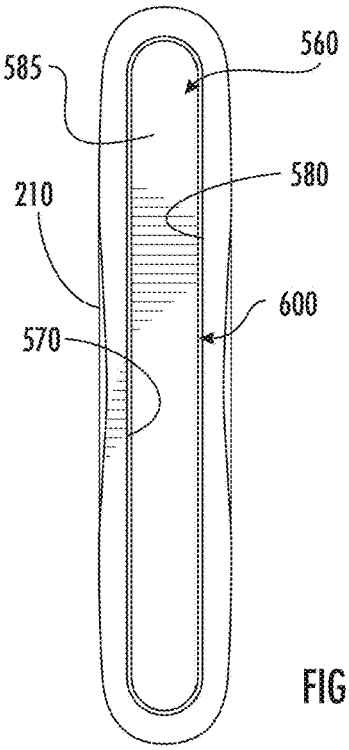
FIG. 17 is another perspective view of a component of the hair coloring brush.
Figure 18:
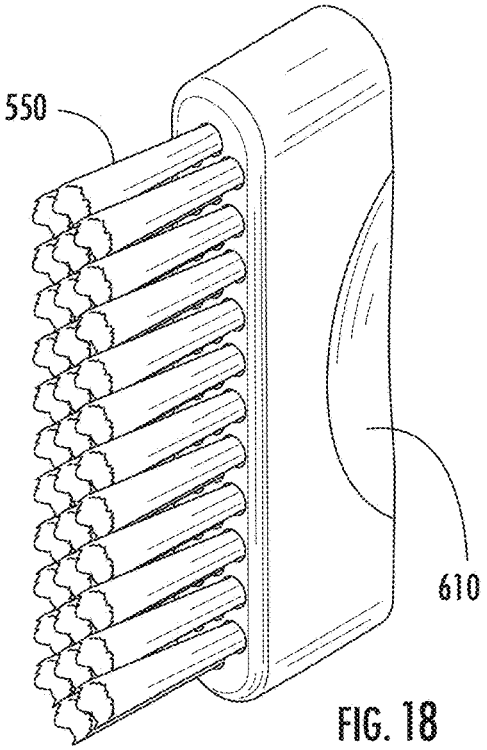
FIG. 18 is another perspective view of a component of the hair coloring brush.

The first side 110 and the second side 120 can have rounded or curved ends 115*a* and 115*b*. The distance between the first side 110 and the second side 120, or the width of the brush attachment protrusion 90, can be approximately half of the width of the handle 20. In one arrangement, the width of the brush attachment protrusion 90 can be approximately 10 cm. The rounded or curved ends 115*a* and 115*b* can be approximately parallel to each other. In other embodiment, rounded or curved ends 115*a* and 115*b* can be not parallel to each other. As an example, one of rounded or curved ends 115*a* and 115*b*, or both rounded or curved ends 115*a* and 115*b*, can be angled toward or away from each other. In one example, one of the rounded or curved ends 115*a* and 115*b*, or both the rounded or curved ends 115*a* and 115*b*, can form an angle with the flat surface 100 that is greater than or equal to approximately 90°. In another embodiment, one of the rounded or curved ends 115*a* and 115*b*, or both rounded or curved ends 115*a* and 115*b*, can form an angle with the flat surface 100 that is approximately 92°, as shown in FIG. 2 by angle α, such that the rounded or curved ends 115*a* and 115*b* are angled toward each other.

Also, the first side 110 can include a first side ridge 130 and the second side 120 can include a second side ridge 140. The first side ridge 130 and the second side ridge 140 can extend outward from the brush attachment protrusion 90 and can be substantially parallel to the first side 110 and the second side ridge 140, respectively. In another arrangement, the first side ridge 130 and the second side 120 can be angled toward or away from each other at the same angle of the first side 110 and the second side 120. In another arrangement, the first side ridge 130 and the second side ridge 140 can connect to form a single side ridge such that the ridge extends continuously from the first side 110 to the second side 120 of protrusion 90 around rounded or curved ends 115*a* and 115*b*. Still further, the first side ridge 130 and/or the second side ridge 140, or the single continuous side ridge, can terminate with a rounded end.

The cap 30 can include a work end with bristles 150 and an internal insertion cavity 160. The bristles 150 can be used to apply hair coloring agents and/or other hair coloring compositions. The insertion cavity 160 can be located at the end of cap 30 opposite the bristles 150. The insertion cavity 160 can receive the brush attachment protrusion 90 at the distal handle end 50 of handle 20 for a male to female engagement.

The insertion cavity 160 can have a first internal wall 170, a second internal wall 180, and a back wall 185 at the back of insertion cavity 160. The first internal wall 170 and the second internal wall 180 can be substantially parallel to each other. In another embodiment, the first internal wall 170 and the second internal wall 180 can be not parallel to each other. As an example, one of the first internal wall 170 and the second internal wall 180, or both the first internal wall 170 and the second internal wall 180, can be angled away from each other. In one example, one of the first internal wall 170 and the second internal wall 180, or both the first internal wall 170 and the second internal wall 180, can form an angle with the internal back wall 185 that is greater than 90°. In another embodiment, one of the first internal wall 170 and the second internal wall 180, or both the first internal wall 170 and the second internal wall 180, can form an angle with the internal back wall 185 that can be greater than or less than 90°. In such an arrangement, the angle of one of the first internal wall 170 and the second internal wall 180, or both the first internal wall 170 and the second internal wall 180, can correspond to the angle of one of the first side 110 and the second side 120, or both first side 110 and the second side 120, to the flat surface 100. As an example, in an arrangement where one of the first internal wall 170 and the second internal wall 180, or both the first internal wall 170 and the second internal wall 180 are angled towards each other, one of the first side 110 and the second side 120, or both first side 110 and the second side 120, can be angled away from each other at the same or matching offset of one of the first internal wall 170 and the second internal wall 180, or both the first internal wall 170 and the second internal wall 180. In this arrangement, the angles are complimentary or anatomically matching.

The first internal wall 170 and the second internal wall 180 can be substantially flat surfaces. The first internal wall 170 and the second internal wall 180 can be connected by opposing side walls 190*a* and 190*b* that are curved to anatomically match the curvature of the rounded or curved ends 115*a* and 115*b*. Additionally, the side walls 190*a* and 190*b* can be substantially parallel to each other. In other arrangement, the side walls 190*a* and 190*b* can be not parallel with each other. In one example, the side walls 190*a* and 190*b* can be angled away from each other at an angle that is greater than 90°. In one example, the side walls 190*a* and 190*b* can be angled away from each other at an a 92° angle as shown in FIG. 2 as angle β. In such an arrangement, the angle of one of the side walls 190*a* and 190*b*, or both the side walls 190*a* and 190*b*, can correspond to the angle of one of the rounded or curved ends 115*a* and 115*b*, or both the rounded or curved ends 115*a* and 115*b*, to the flat surface 100.

As an example, in an arrangement where one of the side walls 190*a* and 190*b*, or both the side walls 190*a* and 190*b* are angled away from each other, one of the rounded or curved ends 115*a* and 115*b*, or both the rounded or curved ends 115*a* and 115*b*, can be angled towards each other at the same or matching offset of one of the side walls 190*a* and 190*b*, or both the side walls 190*a* and 190*b*. In this arrangement, the angles are complimentary or anatomically matching.

Additionally, the first internal wall 170 and the second internal wall 180 can be substantially the same length as the first side 110 and a second side 120 of protrusion 90. Additionally, the depth of insertion cavity 160 can be substantially the same length as the height of protrusion 90. Such components can have anatomically matching dimensions such that the when the protrusion 90 is inserted in the insertion cavity 160 the components have a snug fit.

The insertion cavity 160 can include an internal grove 200. The internal groove 200 can extend along a portion of insertion cavity 160 or continuously along the internal surface of insertion cavity 160 such that the internal groove forms a ring. As an example, the internal groove 200 can be two opposing internal grooves 200*a* and 200*b* located on first internal wall 170 and the second internal wall 180, respectively.

The internal groove 200, or opposing internal grooves 200*a* and 200*b*, can have a depth that anatomically matches the height of first side ridge 130 and the second side 120, or the single side ridge when the first side ridge 130 and the second side 120 are continuous to form a continuous single side ridge. The depth can be approximately 0.5 cm and the height can be approximately 0.5 cm. Accordingly, when the protrusion 90 of handle 20 is inserted into the insertion cavity 160 of cap 30, the first side ridge 130 and the second side 120, or the single continuous side ridge, inserts into the internal groove 200, or opposing internal grooves 200*a* and 200*b*, ensuring a snug friction fit. The insertion of the first side ridge 130 and the second side 120, or the single continuous side ridge, into the internal groove 200, or opposing internal grooves 200*a* and 200*b*, retains the cap 30 with a tension fit on the handle 20 for use by a user.

Additionally, the components of the handle 20 and cap 30 can be made of a flexible plastic or other flexible material. The flexibility of the material allows the cap 30 to flex and the protrusion 90 of handle 20 to flex such that the cap 30 can be press fit onto the handle 20 or tension fit with the handle 20 with the anatomical matching structures as discussed above.

In one embodiment, the cap 30 can include a concave surface 210. The concave surface 210 of the cap 30 can join with the concave surface 80 of handle 20. When the cap 30 is inserted on the handle 20, the concave surface 210 of cap 30 can align with the concave surface 80 such that concave surface 210 of cap 30 and concave surface 80 of handle 20 form a continuous concave surface.

In another embodiment illustrated at Figures at 10-18, a hair coloring brush 400 can have a handle 420 and a detachable brush cap 430. The detachable brush cap 430 can be removably attached to the handle 420 such that the detachable brush cap 430 can be attached to and removed from the handle 420.

The handle 420 can have an elongated body 440 that extends from a distal end 450, where the attachable brush cap 430 attaches to the handle 420, to the opposing end of the handle 420. The handle 420 can have an ergonomic shape that a user is able to firmly grasp. The handle 420 can terminate at a proximal end 460 in a frustoconical end section 470 with flat surface 475. The frustoconical end section 470 provides an ergonomic grip and the flat surface 475 allows the hair coloring brush 400 to stand upright on the flat surface 475.

The handle 420 can also have a concave surface 480 located proximate to the distal end 450 of the handle 420. The concave surface 480 provides a grip surface for a user's finger, such as a user's thumb, when the handle 420 is held in the user's hand.

The distal end 450 of the handle 420 can include a brush attachment protrusion 490 having a brush attachment protrusion height. In one example, the brush attachment protrusion height can be 14 cm. The brush attachment protrusion 490 can extend outward from a flat surface 500 on the distal end 450 of handle 420 the length of the brush attachment protrusion height. The brush attachment protrusion 490 can be substantially orthogonal to the flat surface 500. In another embodiment, the brush attachment protrusion 490 can be not orthogonal to the flat surface 500.

The brush attachment protrusion 490 can have a first side 510 and a second side 520, which can be substantially flat surfaces. The first side 510 and the second side 520 can be substantially parallel to each other. In another embodiment, the first side 510 and the second side 520 can be not parallel to each other. As an example, one of the first side 510 and the second side 520, or both first side 510 and the second side 520, can be angled toward or away from each other. In one example, one of first side 510 and the second side 520, or both the first side 510 and the second side 520, can form an angle with the flat surface 500 that is greater than or equal to approximately 90°. In another embodiment, one of the first side 510 and the second side 520, or both first side 510 and the second side 520, can form an angle with the flat surface 500 that is approximately 90°.

The first side 510 and the second side 520 can have rounded or curved ends 515*a* and 515*b*. The distance between the first side 510 and the second side 520, or the width of the brush attachment protrusion 490, can be approximately 75% to 85%, or 80%, of the width of the handle 420. In one arrangement, the width of the brush attachment protrusion 490 can be approximately 10 cm. The rounded or curved ends 515*a* and 515*b* can be approximately parallel to each other. In other embodiment, rounded or curved ends 515*a* and 515*b* can be not parallel to each other. As an example, one of rounded or curved ends 515*a* and 515*b*, or both rounded or curved ends 515*a* and 515*b*, can be angled toward or away from each other. In one example, one of the rounded or curved ends 515*a* and 515*b*, or both the rounded or curved ends 515*a* and 515*b*, can form an angle with the flat surface 500 that is greater than or equal to approximately 90°. In another embodiment, one of the rounded or curved ends 515*a* and 515*b*, or both rounded or curved ends 515*a* and 515*b*, can form an angle with the flat surface 500 that is approximately 92°, as shown in FIG. 2 by angle α'.

Also, the first side 510 can include a first side ridge 530 and the second side 520 can include a second side ridge 540. The first side ridge 530 and the second side 520 can extend outward from the brush attachment protrusion 490 and can be substantially parallel to the first side 510 and the second side 520, respectively. In another arrangement, the first side ridge 530 and the second side 520 can be angled toward or away from each other at the same angle of the first side 510 and the second side 520. In another arrangement, the first side ridge 530 and the second side 520 can connect to form a single side ridge such that the ridge extends continuously from the first side 510 to the second side 520 of protrusion 490 around rounded or curved ends 515*a* and 515*b*. Still further, the first side ridge 530 and/or the second side 520, or the single side ridge, can terminate with a rounded end.

The cap 430 can include a work end with bristles 550 and an internal insertion cavity 560. The bristles 550 can be used to apply hair coloring agents and/or other hair coloring compositions. The insertion cavity 560 can be located at the end of cap 430 opposite the bristles 550. The insertion cavity 560 can receive the brush attachment protrusion 490 at the distal handle end 450 of handle 420 for a male to female engagement.

The insertion cavity 560 can have a first internal wall 570, a second internal wall 580, and a back wall 585 at the back of insertion cavity 560. The first internal wall 570 and the second internal wall 580 can be substantially parallel to each other. In another embodiment, the first internal wall 570 and the second internal wall 580 can be not parallel to each other. As an example, one of the first internal wall 570 and the second internal wall 580, or both the first internal wall 570 and the second internal wall 580, can be angled away from each other. In one example, one of the first internal wall 570 and the second internal wall 580, or both the first internal wall 570 and the second internal wall 580, can form an angle with the internal back wall 585 that is greater than 90°. In another embodiment, one of the first internal wall 570 and the second internal wall 580, or both the first internal wall 570 and the second internal wall 580, can form an angle with the internal back wall 585 that can be greater than or less than 90°. In such an arrangement, the angle of one of the first internal wall 570 and the second internal wall 580, or both the first internal wall 570 and the second internal wall 580, can correspond to the angle of one of the first side 510 and the second side 520, or both first side 510 and the second side 520, to the flat surface 500. As an example, in an arrangement where one of the first internal wall 570 and the second internal wall 580, or both the first internal wall 570 and the second internal wall 580 are angled towards each other, one of the first side 510 and the second side 520, or both first side 510 and the second side 520, can be angled away from each other at the same or matching offset of one of the first internal wall 570 and the second internal wall 580, or both the first internal wall 570 and the second internal wall 580. In this arrangement, the angles are complimentary or anatomically matching.

The first internal wall 570 and the second internal wall 580 can be substantially flat surfaces. The first internal wall 570 and the second internal wall 580 can be connected by opposing side walls 590*a* and 590*b* that are curved to anatomically match the curvature of the rounded or curved ends 515*a* and 515*b*. Additionally, the side walls 590*a* and 590*b* can be substantially parallel to each other. In other arrangement, the side walls 590*a* and 590*b* can be not parallel with each other. In one example, the side walls 590*a* and 590*b* can be angled away from each other at an angle that is greater than 90°. In one example, the side walls 590*a* and 590*b* can be angled away from each other at an a 92° angle, as shown in FIG. 2 as angle β'. In such an arrangement, the angle of one of the side walls 590*a* and 590*b*, or both the side walls 590*a* and 590*b*, can correspond to the angle of one of the rounded or curved ends 515*a* and 515*b*, or both the rounded or curved ends 515*a* and 515*b*, to the flat surface 500.

As an example, in an arrangement where one of the side walls 590*a* and 590*b*, or both the side walls 590*a* and 590*b* are angled away from each other, one of the rounded or curved ends 515*a* and 515*b*, or both the rounded or curved ends 515*a* and 515*b*, can be angled towards each other at the same or matching offset of one of the side walls 590*a* and 590*b*, or both the side walls 590*a* and 590*b*. In this arrangement, the angles are complimentary or anatomically matching.

Additionally, the first internal wall 570 and the second internal wall 580 can be substantially the same length as the first side 510 and a second side 520 of protrusion 490. Additionally, the depth of insertion cavity 560 can be substantially the same length as the height of protrusion 490. Such components can have anatomically matching dimensions such that the when the protrusion 490 is inserted in the insertion cavity 560 the components have a snug fit.

The insertion cavity 560 can include an internal grove 600. The internal groove 600 can extend along a portion of insertion cavity 560 or continuously along the internal surface of insertion cavity 560 such that the internal groove forms a ring. As an example, the internal groove 600 can be two opposing internal grooves 600*a* and 600*b* located on first internal wall 570 and the second internal wall 580, respectively.

The internal groove 600, or opposing internal grooves 600*a* and 600*b*, can have a depth that anatomically matches the height of first side ridge 530 and the second side ridge 540, or the single side ridge when the first side ridge 530 and the second side ridge 540 are continuous to form a continuous single side ridge. The depth can be approximately 0.5 cm and the height can be approximately 0.5 cm. Accordingly, when the protrusion 490 of handle 420 is inserted into the insertion cavity 560 of cap 430, the first side ridge 530 and the second side ridge 540, or the single side ridge when the first side ridge 530 and the second side ridge 540 are continuous to form a continuous single side ridge, inserts into the internal groove 600, or opposing internal grooves 600*a* and 600*b*, ensuring a snug friction fit. The insertion of the first side ridge 530 and the second side ridge 540, or the single side ridge when the first side ridge 530 and the second side ridge 540 are continuous to form a continuous single side ridge, inserts into the internal groove 600, or opposing internal grooves 600*a* and 600*b*, retains the cap 430 with a tension fit on the handle 420 for use by a user.

Additionally, the components of the handle 420 and cap 430 can be made of a flexible plastic or other flexible material. The flexibility of the material allows the cap 430 to flex and the protrusion 490 of handle 420 to flex such that the cap 430 can be press fit onto the handle 420 or tension fit with the handle with the anatomical matching structures as discussed above.

In one embodiment, the cap 430 can include a concave surface 610. The concave surface 610 of the cap 430 can join with the concave surface 480 of handle 420. When the cap 430 is inserted on the handle 420, the concave surface 610 of cap 20 can align with the concave surface 480 such that concave surface 610 of cap 430 and concave surface 480 of handle 420 form a continuous concave surface.

Figure 19:
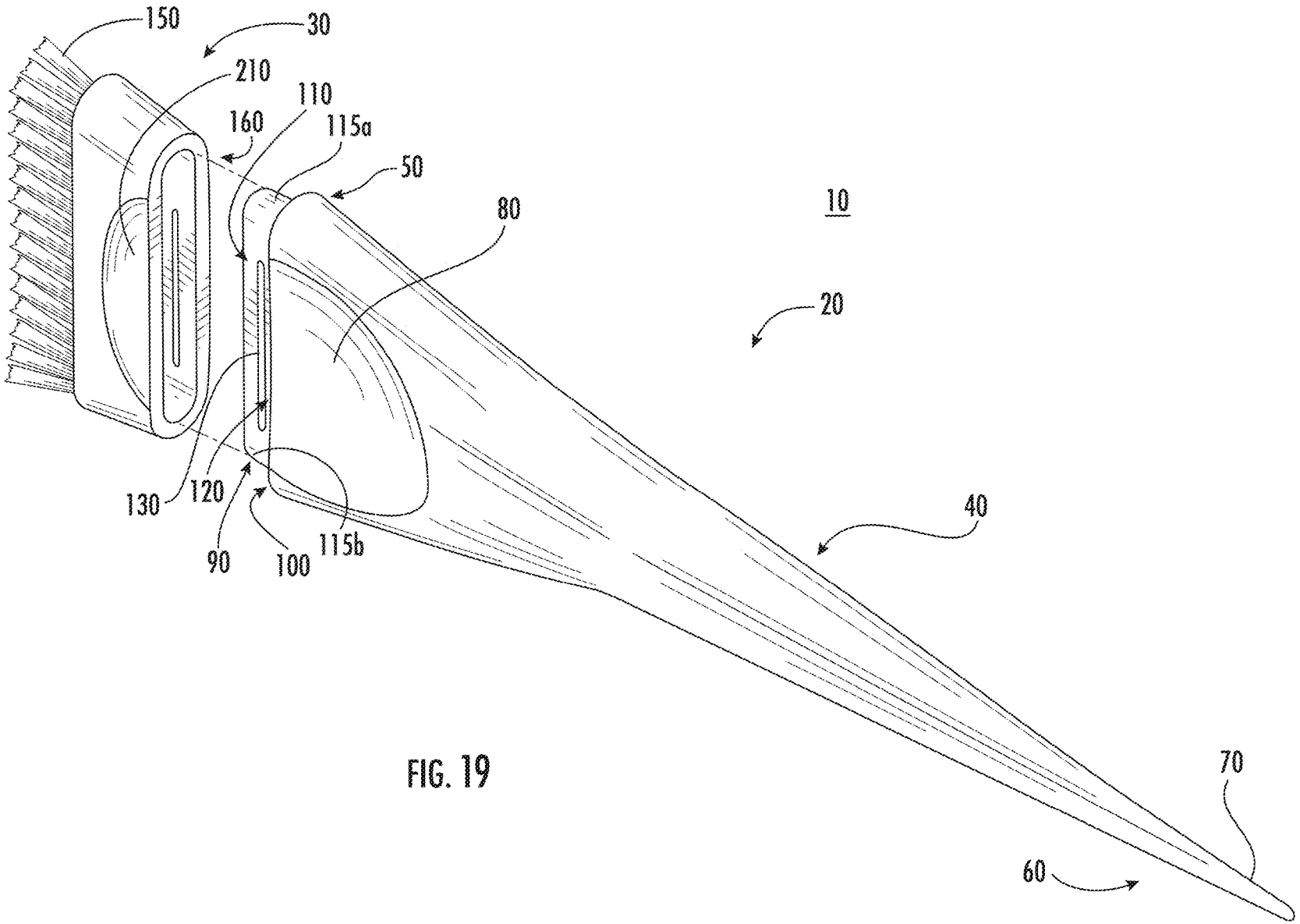
FIG. 19 is a perspective exploded view of another embodiment of a hair coloring brush.

In another embodiment at FIG. 19 where like reference numbers are used for like components, another embodiment of a hair coloring brush 10 is illustrated. A first side 110 can include a first side ridge 130 and the second side 120 can include a second side ridge 140. In this embodiment, the first side ridge 130 is not continuous with the second side ridge 140. Both the first side ridge 130 and the second side ridge 140 can extend along protrusion 90 and not extend beyond the width of the concave surface 80.

Figure 20:
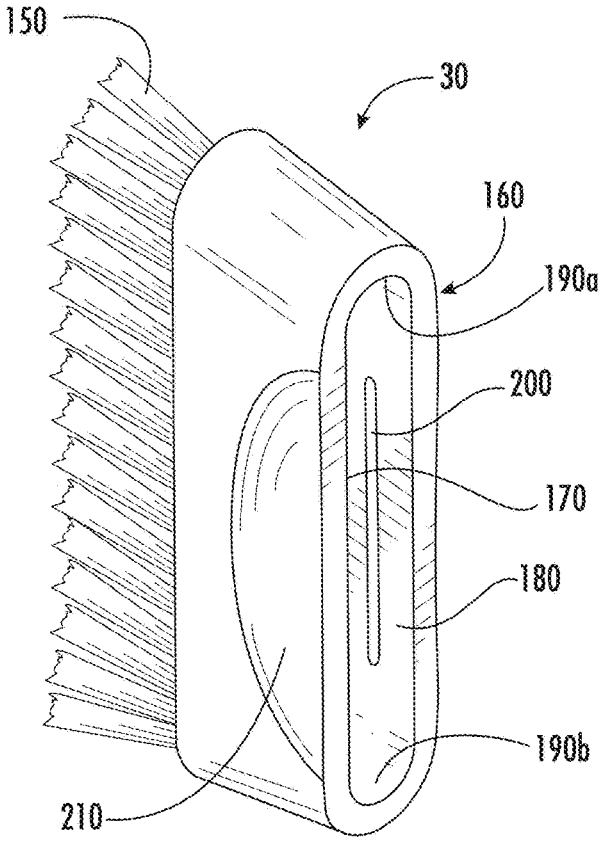
FIG. 20 is a perspective view of a component of the hair coloring brush of FIG. 19.

In another embodiment at FIG. 20 where like reference numbers are used for like components, another embodiment of a component of a hair coloring brush 10 is illustrated. In this embodiment, the insertion cavity 160 can include an internal grove 200 that is not continuous. Also, the internal groove 200 can be two opposing internal grooves 200*a* and 200*b* located on first internal wall 170 and the second internal wall 180, respectively. Accordingly, the internal groove 200 can be not continuous. The internal groove 200, or opposing internal grooves 200*a* and 200*b*, can have a depth that anatomically matches the height of first side ridge 130 and the second side ridge 140, or the single side ridge when the first side ridge 130 and the second side ridge 140 are continuous to form a continuous single side ridge. In this regard, an insertion cavity 160 with a continuous internal grove 200 can be joined with both a handle having a first side ridge 130 and the second side ridge 140 that are continuous with each other, or a handling a handle having a first side ridge 130 and a second side ridge 140 that are not continuous with each other. Similarly, an insertion cavity 160 with opposing internal grooves 200*a* and 200*b* that are not continuous with each other can be joined with both a handle having a first side ridge 130 and the second side ridge 140 that are continuous with each other, or a handling a handle having a first side ridge 130 and a second side ridge 140 that are not continuous with each other.

Figure 21:
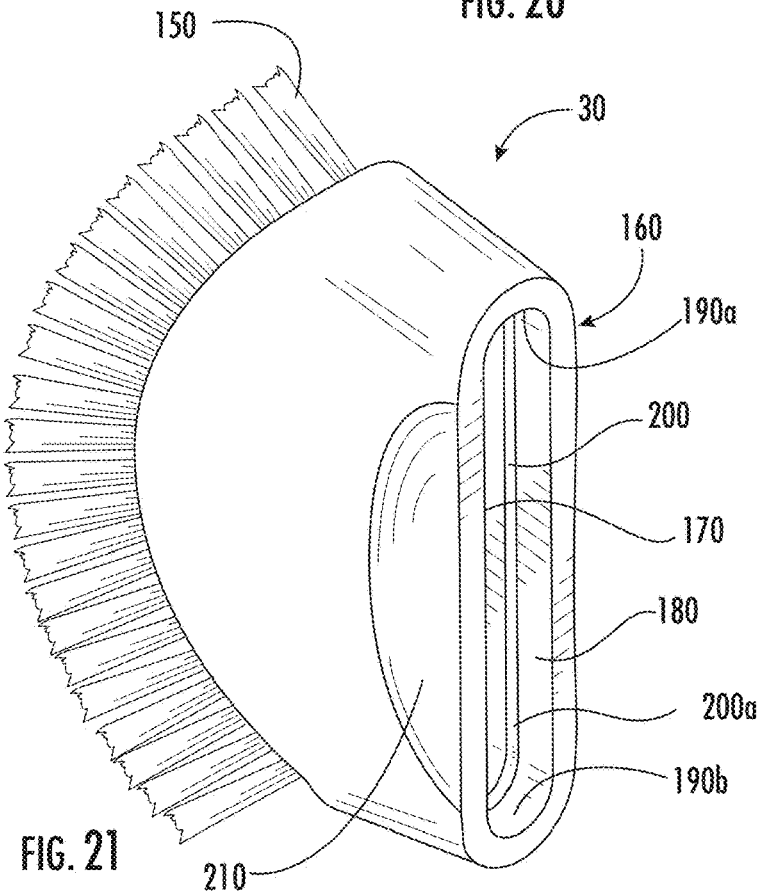
FIG. 21 is a perspective view of another embodiment of a component of the hair coloring brush.

In another embodiment at FIG. 21 where like reference numbers are used for like components, another embodiment of a component of a hair coloring brush 10 is illustrated. The detachable brush cap 30 can fit on handle 20. In this arrangement, multiple, different detachable brush caps 30 can fit on and be interchangeable with handle 20 to allow for different brush styles with the same handle 20.

This disclosure describes various elements, features, aspects, and advantages of various embodiments and examples and configurations thereof of composite compositions. It is to be understood that certain descriptions of the various embodiments have been simplified to illustrate only those elements, features and aspects that are relevant to a more clear understanding of the disclosed embodiments, while eliminating, for purposes of brevity or clarity, other elements, features and aspects. Any references to "various embodiments," "certain embodiments," "some embodiments," "one example," "one embodiment," "an example," or "an embodiment" generally means that a particular element, feature and/or aspect described in the embodiment is included in at least one embodiment. The phrases "in various embodiments," "in certain embodiments," "in some embodiments," "in one embodiment," or "in an embodiment" may not refer to the same embodiment." Furthermore, the phrases "in one such embodiment" or "in certain such embodiments," or "in one example," while generally referring to and elaborating upon a preceding embodiment, is not intended to suggest that the elements, features, and aspects of the embodiment introduced by the phrase are limited to the preceding embodiment; rather, the phrase is provided to assist the reader in understanding the various elements, features, and aspects disclosed herein and it is to be understood that those having ordinary skill in the art will recognize that such elements, features, and aspects presented in the introduced embodiment may be applied in combination with other various combinations and sub-combinations of the elements, features, and aspects presented in the disclosed embodiments. It is to be appreciated that persons having ordinary skill in the art, upon considering the descriptions herein, will recognize that various combinations or sub-combinations of the various embodiments and other elements, features, and aspects may be desirable in particular implementations or applications. However, because such other elements, features, and aspects may be readily ascertained by persons having ordinary skill in the art upon considering the description herein, and are not necessary for a complete understanding of the disclosed embodiments, a description of such elements, features, and aspects may not be provided. As such, it is to be understood that the description set forth herein is merely exemplary and illustrative of the disclosed embodiments and is not intended to limit the scope of the invention as defined solely by the claims.

The invention claimed is:

1. A hair coloring brush, comprising:
- a handle, comprising:
  - an elongated body;
  - a brush attachment protrusion, wherein the brush attachment protrusion extends outward from the elongated body and has a first protrusion side and a second protrusion side;
  - a first side ridge on the first protrusion side;
  - a second side ridge on the second protrusion side;
- a detachable brush cap that detachably couples to the handle, wherein the detachable brush cap comprises:
  - a distal brush end;
  - a plurality of bristles extending from the distal brush end;
  - a cavity opposite the distal brush end, wherein the cavity has a cavity wall;
  - an internal groove located in the cavity wall;
- wherein the first side ridge on the first protrusion side and the second side ridge on the second protrusion side tension fit in the internal groove when the detachable brush cap is inserted over the brush attachment protrusion,
- a handle concave surface on the elongated body; and
- a cap concave surface on the detachable brush cap;
- wherein the handle concave surface and cap concave surface form a continuous concave surface when the detachable brush cap is coupled to the handle.

2. The hair coloring brush of claim 1, wherein the first side ridge and the second side ridge are not parallel to each other.

3. The hair coloring brush of claim 1, wherein the first side ridge and the second side ridge are substantially flat.

4. The hair coloring brush of claim 1, wherein the brush attachment protrusion is substantially orthogonal to the elongated body.

5. The hair coloring brush of claim 1, wherein the brush attachment protrusion has a brush attachment protrusion height and the cavity has a cavity depth, and wherein the brush attachment protrusion height is substantially the same as the cavity depth.

6. The hair coloring brush of claim 1, wherein the first protrusion side and the second protrusion side are not parallel to each other.

7. The hair coloring brush of claim 1, wherein the brush attachment protrusion extends outward from the elongated body at an angle that is complimentary to an angle of the cavity wall.

8. A hair coloring brush, comprising:
- a handle, comprising:
  - an elongated body;
  - a brush attachment protrusion, wherein the brush attachment protrusion extends outward from the elongated body and has a first protrusion side and a second protrusion side;
  - a continuous ridge that continuously extends along the first protrusion side and the second protrusion side;
- a detachable brush cap that detachably couples to the handle, wherein the detachable brush cap comprises:
  - a distal brush end;

a plurality of bristles extending from the distal brush end;

a cavity opposite the distal brush end, wherein the cavity has a cavity wall;

a continuous internal groove located in the cavity wall, wherein the internal groove is continuous along the cavity wall;

wherein the continuous ridge tension fits in the continuous internal groove when the detachable brush cap is inserted over the brush attachment protrusion;

a handle concave surface on the elongated body; and a cap concave surface on the detachable brush cap;

wherein the handle concave surface and cap concave surface form a continuous concave surface when the detachable brush cap is coupled to the handle.

9. The hair coloring brush of claim 8, wherein the first side ridge and the second side ridge are substantially parallel to each other.

10. The hair coloring brush of claim 8, wherein the first side ridge and the second side ridge are substantially flat.

11. The hair coloring brush of claim 8, wherein the brush attachment protrusion is substantially orthogonal to the elongated body.

12. The hair coloring brush of claim 8, wherein the brush attachment protrusion has a brush attachment protrusion height and the cavity has a cavity depth, and wherein the brush attachment protrusion height is substantially the same as the cavity depth.

13. The hair coloring brush of claim 8, wherein the first protrusion side and the second protrusion side are not parallel to each other.

14. The hair coloring brush of claim 8, wherein the first protrusion side and a second protrusion side protrude at an angle to the elongated body that is complimentary to an angle of the cavity wall.

* * * * *